US007665474B2

(12) United States Patent
Morales

(10) Patent No.: US 7,665,474 B2
(45) Date of Patent: Feb. 23, 2010

(54) DISPOSABLE EYEBROW DYE KIT

(76) Inventor: Virginia Morales, 7 Holyoke Dr., Delran, NJ (US) 08075

( * ) Notice: Subject to any disclaimer, the term of this patent is extended or adjusted under 35 U.S.C. 154(b) by 450 days.

(21) Appl. No.: 11/810,536

(22) Filed: Jun. 6, 2007

(65) Prior Publication Data

US 2008/0302380 A1 Dec. 11, 2008

(51) Int. Cl.
*A45D 40/30* (2006.01)
*A45D 40/26* (2006.01)
*B43K 5/00* (2006.01)

(52) U.S. Cl. ..... 132/218; 132/216; 401/202

(58) Field of Classification Search ..... 132/218, 132/216, 320, 317, 318; 401/202, 134; 222/83
See application file for complete search history.

(56) References Cited

U.S. PATENT DOCUMENTS 3,482,920 A * 12/1969 Schwartzman ..... 401/132
5,052,589 A * 10/1991 O'Meara ..... 222/83
5,778,902 A * 7/1998 Nagy ..... 132/200
6,189,688 B1 * 2/2001 Aneas ..... 206/219
6,976,494 B2 * 12/2005 Wayne et al. ..... 132/108
2007/0020028 A1 * 1/2007 Levine ..... 401/134

* cited by examiner

*Primary Examiner*—Robyn Doan
(74) *Attorney, Agent, or Firm*—Stuart M. Goldstein

(57) ABSTRACT

A disposable eyebrow dye kit includes two separate primary components. The first component is an elongated container consisting of two compartments separated by a thin membrane. One compartment contains a hair developer, for instance hydrogen peroxide and the appropriate colored dye, and the second compartment contains a dye solution, like ammonia. The second component consists of a brush member with brush bristles and a protective cap over the bristles at one end and a connector component at the other end. In use, the brush component is inserted into the container where the protective cap punctures the membrane separating the two compartments. The solution in one compartment is allowed to mix with the solution in the second compartment to form the dye mixture which is to be applied to the eyebrows. The brush component is then withdrawn from the container, causing the cap over the bristles of the brush component to fall to the bottom of the container. The brush component is then used to apply the dye directly to the eyebrows. When the dying operation is complete, the kit may be disposed of.

10 Claims, 2 Drawing Sheets

DISPOSABLE EYEBROW DYE KIT

BACKGROUND OF THE INVENTION

The shape, size, and color of eyebrows, whether that of men or women, is often a significant factor in a person's overall facial appearance. As a result, individuals go to great lengths to have well groomed, shaped, and colored eyebrows. A key aspect of this process involves ensuring that eyebrows are properly colored, e.g. dyed, to match or coordinate with hair for facial features.

In the past, coloring or dying one's eyebrows was left to beauticians or other professionals who use elaborate techniques to perform eyebrow dying operations. It has always been most difficult for individuals to easily and efficiently dye eyebrows by themselves, and in the comfort of their own homes or space of choice.

SUMMARY OF THE INVENTION

It is thus the object of the present invention to address the disadvantages and limitations of prior eyebrow dying systems.

It is an object of the present invention to provide an eyebrow dye kit which is easy and efficient to use.

It is a further object of the present invention to provide an eyebrow dye kit which can be easily employed to dye an individual's eyebrows and then be readily disposed of.

It is still another object of the present invention to provide an eyebrow dye kit which comprises the appropriate ingredients to dye one's eyebrows, self-contained in a single kit.

It is a further object of the present invention to provide an eyebrow dye kit which comprises a brush component and a separate dye solution storage container which is compact and ready for immediate use.

These and other objects are accomplished by the present invention, a disposable eyebrow dye kit which includes two separate primary components. The first component is an elongated container consisting of two compartments separated by a thin membrane. One compartment contains a hair developer solution, for instance hydrogen peroxide and the appropriate colored dye, and the second compartment contains a dye solution like ammonia. The second component consists of a brush member with brush bristles and a protective cap over the bristles at one end and a connector component at the other end. In use, the brush component is inserted into the container where the protective cap punctures the membrane separating the two compartments. The solution in one compartment is allowed to mix with the solution in the second compartment to form the dye mixture which is to be applied to the eyebrows. The brush component is then withdrawn from the container, causing the cap over the bristles of the brush component to fall to the bottom of the container. The brush component is then used to apply the dye directly to the eyebrows. When the dying operation is complete, the kit may be disposed of.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
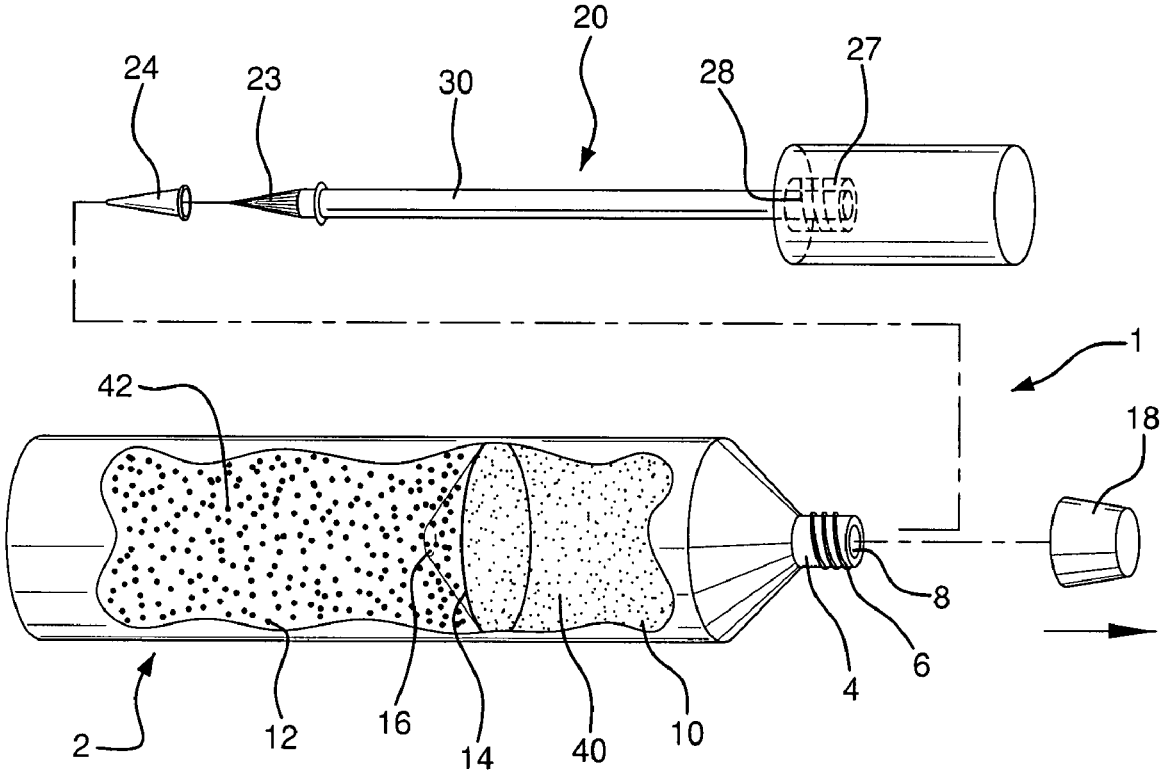
FIG. 1 shows the two primary elements of the present invention, the container and the brush component.
Figure 2:
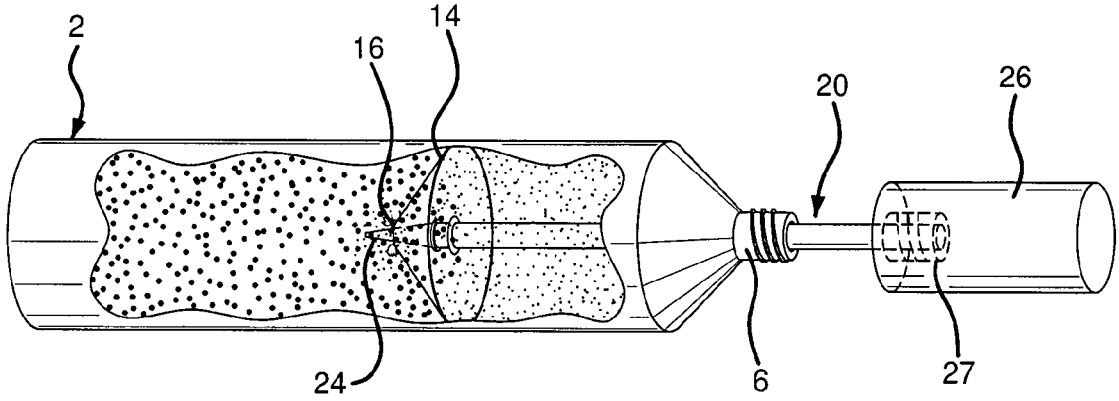
FIG. 2 shows the process of using the brush component within the container to allow mixture of the fluid dye elements.
Figure 3:
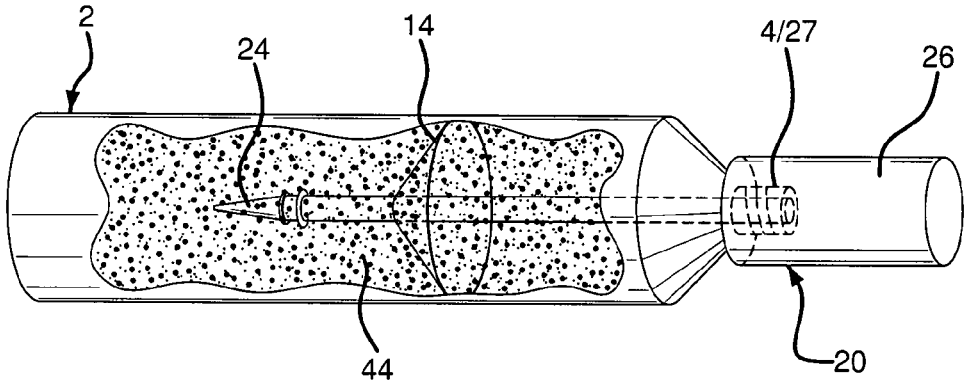
FIG. 3 shows the brush component extended into the container of the present invention.

Eyebrow dye kit 1 of the present invention comprises elongated container 2 which has upper connector section 4 with threads 6. Opening 8 extends through connector section 4, which can be made of rubber, flexible plastic, or other equivalent pliable material. Container 2 further comprises separate compartments 10 and 12, separated by thin membrane 14. Membrane 14 has thinner lower section 16 which is configured to be punctured, as will be described hereinafter. Membrane 14 is to be constructed of rigid yet flexible material which, as stated above, is designed to be punctured at its thinner lower end 16. Cover 18 is configured to enclose connector section 4.

It is contemplated that elongated container 2 will be approximately two to two and a quarter inches in height and five eighths inches in diameter, so that it is easily transportable within a purse or pocketbook of a user. However, the invention is not to be considered restrictive to these dimensions or the particular disclosed configuration of container 2.

Disposable eyebrow dye kit 1 further comprises brush component 20 which, at one of its ends, has brush bristles 22 configured to be covered by pointed cap 24. Cap 24 is to be constructed of a hard material, such as plastic, sufficient to puncture thin lower section 16 of membrane 14 upon insertion of brush component 20 into container 2. Located at the other end of brush component 20 is handle section 26 with brush connector 27, comprising threads 28 which are configured to be matingly engaged with threads 6 of connector section 4 of container 2. Elongated stem 30 interconnects brush bristles 22 and brush connector 28 and handle section 26.

It is contemplated that a hair developer solution 40 will be contained in compartment 10 and a dye solution 42 will be contained in compartment 12. For example solution 40 could be a hair developer, for instance a mixture of hydrogen peroxide with appropriate colored dye, and the dye solution could be ammonia. However the scope of the invention is not to be considered restricted by the specific dye components which are used.

In use, disposable eyebrow dye kit 1 will be provided with the two separate elements of the invention, container 2 with cover 18 enclosing connector section 4 and brush component 20 with cap 24 snapped over brush bristles 22. When the user desires to apply eyebrow dye, cover 18 is removed from connector section 4 and brush component 20 is inserted into opening 8 of connector section 4 via the insertion of cap 24 enclosing bristles 22. Brush component 20 continues to be inserted into container 2 until cap 24 punctures thinner lower section 16 of membrane 14. When brush component 22 is fully inserted into container 2, connector section 4 and brush connector 27 are screwed together via their respective threads 6 and 28, using handle section 26. Container 2 is then shaken, allowing the hair developer solution 40 to interact and mix with the dye solution 42, resulting in final dye mixture 44.

Once solutions 40 and 42 are suitably mixed to form dye mixture 44, handle section 26 is used to unscrew brush connector 27 from connector section 4 of container 2 and brush component 20 is withdrawn from the container. As brush component 20 is withdrawn, cap 24 contacts membrane 14, what causes it to be detached from brush bristles 22. Cap 24 then falls to the bottom of compartment 12. Once fully withdrawn from container 2, brush component 20 is used to apply eyebrow dye to the user. There is a sufficient quantity of eyebrow dye mixture 44 formed by solutions 40 and 42 to allow the user to completely dye both eyebrows. Once the dye operation is completed, both container 2 and brush component 20 can be disposed of.

Thus, disposable eyebrow dye kit 1 provides an easy, efficient, and effective way to allow the user to dye his or her own eyebrows in a clean and simple manner. Eyebrow kit 1 is readily transportable and easily disposed of upon completion of use.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A disposable eyebrow dye kit comprising:

an elongated container means for storing liquid eyebrow dye components, said container means comprising an upper connector section and two fluid storage compartments separated by a thin membrane within the container means, one compartment storing a first eyebrow dye solution and the second compartment storing a second eyebrow dye solution; and a separate brush means for applying eyebrow dye, said brush means having two ends, one end comprising brush bristles and cap means for covering the brush bristles and the other end comprising connector means for matingly engaging the connector section of the elongated container means, whereby when the connector section and the connector means are engaged, the cap means is configured to puncture the membrane, permitting mixture of the first and second dye solutions within the container means.

2. The disposable eyebrow dye kit as in claim 1 further comprising opening means within the connector section through which the brush bristles and cap means are inserted.

3. The disposable eyebrow dye kit as in claim 1 wherein the membrane comprises a thinner lower section configured to be punctured by the cap means.

4. The disposable eyebrow dye kit as in claim 1 wherein the connector section and the connector means are matingly engaged by means of threaded connection.

5. The disposable eyebrow dye kit as in claim 1 wherein the brush means is configured to be removed from the container means after the cap means punctures the membrane and the first and second dye solutions are mixed, in order to apply the dye solution mixture to a user's eyebrows.

6. The disposable eyebrow dye kit as in claim 5 wherein the cap means is detached from the brush bristles upon removal of the brush means from the container means.

7. The disposable eyebrow dye kit as in claim 1 wherein the cap means is pointed at one end.

8. The disposable eyebrow dye kit as in claim 1 wherein the brush means further comprises an elongated stem, one end of which comprises the brush bristles and the other end of which comprises the connector means.

9. The disposable eyebrow dye kit as in claim 1 further comprising cover means for enclosing the connector section when the connector means of the brush means is not matingly engaged with the connector section.

10. The disposable eyebrow dye kit as in claim 1 further comprising a handle section at one end of the brush means.

* * * * *